US012259144B2

(12) United States Patent
Hoth et al.

(10) Patent No.: US 12,259,144 B2
(45) Date of Patent: Mar. 25, 2025

(54) BASEBOARD HEATER BOOSTER

(71) Applicants: Christopher F. Hoth, Gales Ferry, CT (US); Mark D. Blanchard, Fleming Island, FL (US); Doug F. Melville, Jr., Simsbury, CT (US); Bruce Peter Popek, South Windsor, CT (US); Mark B. Williams, Moss Beach, CA (US)

(72) Inventors: Christopher F. Hoth, Gales Ferry, CT (US); Mark D. Blanchard, Fleming Island, FL (US); Doug F. Melville, Jr., Simsbury, CT (US); Bruce Peter Popek, South Windsor, CT (US); Mark B. Williams, Moss Beach, CA (US)

( * ) Notice: Subject to any disclaimer, the term of this patent is extended or adjusted under 35 U.S.C. 154(b) by 0 days.

(21) Appl. No.: 18/231,442

(22) Filed: Aug. 8, 2023

(65) Prior Publication Data

US 2024/0044519 A1 Feb. 8, 2024

Related U.S. Application Data

(60) Provisional application No. 63/396,212, filed on Aug. 8, 2022.

(51) Int. Cl.
*F24D 19/00* (2006.01)
*F24D 19/10* (2006.01)

(52) U.S. Cl.
CPC ..... *F24D 19/0087* (2013.01); *F24D 19/1084* (2013.01)

(58) Field of Classification Search
CPC ..... F24D 19/0087; F24D 19/1084
USPC ..... 454/229, 287
See application file for complete search history.

(56) References Cited

U.S. PATENT DOCUMENTS 5,181,884 A * 1/1993 Ducharme ..... F24D 19/04 454/246
5,632,677 A * 5/1997 Elkins ..... F04D 25/16 454/329
2021/0095680 A1* 4/2021 Johnson ..... F04D 25/088

OTHER PUBLICATIONS

Radfan (https://www.amazon.co.uk/Radfan-Classic-Medium-Power Radiator/dp/B00I8OW972/ref=cm_cr_arp_d_product_top?ie=UTF8, first available, Oct. 8, 2014) (Year: 2014).*

* cited by examiner

*Primary Examiner* — Vivek K Shirsat
(74) *Attorney, Agent, or Firm* — CANTOR COLBURN LLP

(57) ABSTRACT

A baseboard booster article including a booster housing, wherein the booster housing defines a housing cavity and a housing bottom opening and includes a housing top having at least one top opening. The baseboard booster article further includes a booster support structure, wherein the booster support structure is disposed within the housing cavity and at least one fan associated with the booster support structure to be located within the housing cavity, wherein the at least one fan is operable to cause an airflow to flow into the housing bottom opening, through the housing cavity and out of the at least one top opening.

20 Claims, 12 Drawing Sheets

BASEBOARD HEATER BOOSTER

RELATED APPLICATIONS

This application claims the benefit of U.S. Provisional Patent Application Ser. No. 63/396,212, filed on Aug. 8, 2022, and entitled "Baseboard Heater Booster," the content of which is incorporated herein by reference in its entirety.

FIELD OF THE INVENTION

The present invention relates generally to baseboard heater article, and more particularly to a baseboard heater article that assists with baseboard heat circulation.

BACKGROUND OF THE INVENTION

Baseboard heating has been known for many years and typically include one of two types of heating methods: Convection or Hydronic. With convection baseboard heating, the baseboard heating elements are arranged to be located near the floor along the walls of a room and they contain a heating (resistive) element that heats up when an electrical current flows through the heating element. Convection baseboard heating elements are configured to draw in cool air (typically located near the floor of a room) and warm the cool air over electrically heated metal fins. The heated air is allowed to rise out of the heating element and back into the room, thereby raising the temperature of the room. These convection heaters are the most common and are typically hardwired directly into the building's electrical supply. In hydronic baseboard heating, the baseboard heating element includes pipes that allow an internal reservoir of fluid (such as water) to flow within. The fluid is heated (either by electricity or a building's central heater boiler system) and supplied to the hydronic baseboard heating pipes. As the heated fluid flows through the pipes the heat in the fluid is radiated out into the room thereby distributing radiant heat. This type of baseboard heating is more energy efficient than convection baseboard heating because the fluid reservoir stays warm even after the heat source has turned off, so it doesn't require a constant supply of energy to maintain the desired heat level.

Baseboard heating has several advantages, including no ducting is required, they are easy to clean, they rarely breakdown, the temperature in each room can be individually set, they are easy to install, and they are generally quiet. Unfortunately, however, baseboard heating has several disadvantages which include being expensive to operate and having an uneven and inconsistent heat distribution within a room (i.e., hot areas, cold areas).

SUMMARY

A baseboard booster article including a booster housing, wherein the booster housing defines a housing cavity and a housing bottom opening and includes a housing top having at least one top opening. The baseboard booster article further includes a booster support structure, wherein the booster support structure is disposed within the housing cavity and at least one fan associated with the booster support structure to be located within the housing cavity, wherein the at least one fan is operable to cause an airflow to flow into the housing bottom opening, through the housing cavity and out of the at least one top opening.

A baseboard booster article including a booster housing, wherein the booster housing includes a housing top, a housing first side and a housing second side, wherein housing top, structure first side and structure second side define a housing cavity and a housing bottom opening, a booster support structure, wherein the booster support structure is disposed within the housing cavity, and at least one fan associated with the booster support structure to be located within the housing cavity, wherein the at least one fan is operable to cause an airflow to flow into the housing bottom opening, through the housing cavity.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION

Figure 1:
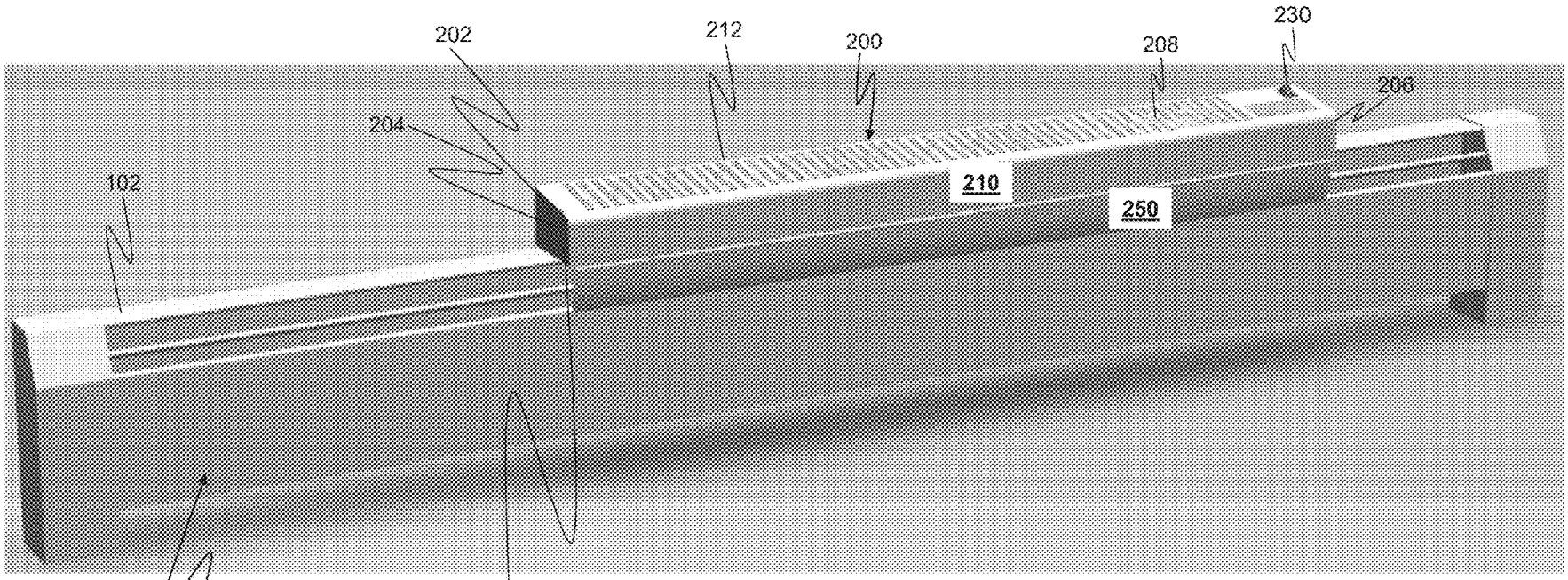
FIG. 1 is a front perspective view of a baseboard booster associated with a baseboard heater, in accordance with an embodiment of the invention.
Figure 2:
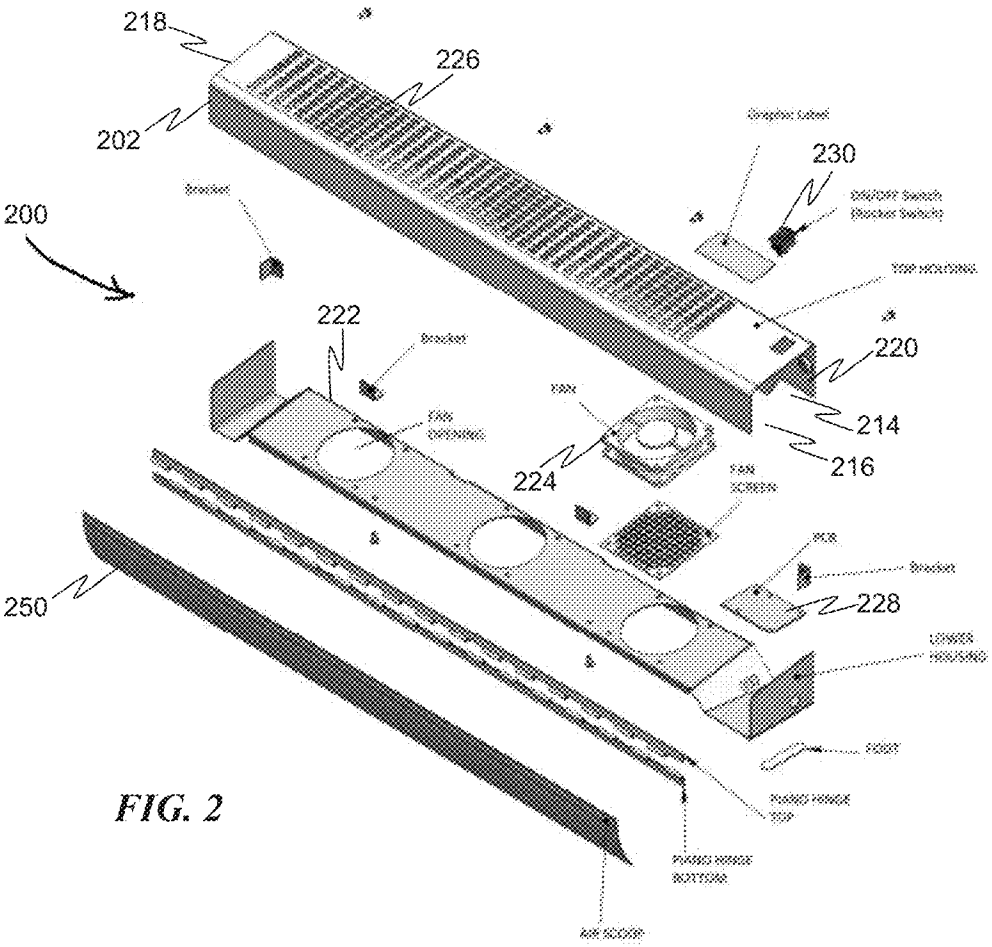
FIG. 2 is an exploded view of a baseboard booster, in accordance with an embodiment of the invention.
Figure 3:
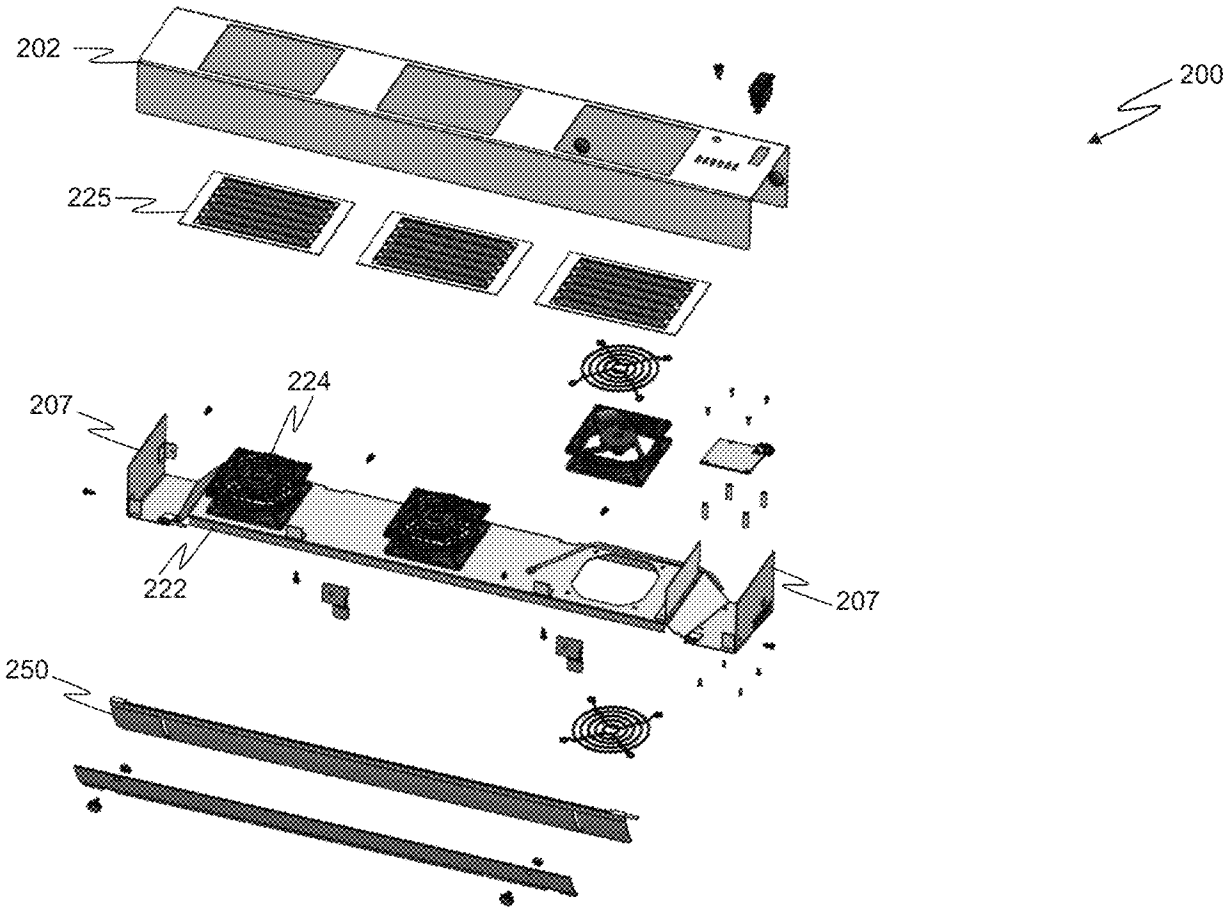
FIG. 3 is an exploded view of a baseboard booster, in accordance with an embodiment of the invention.
Figure 4:
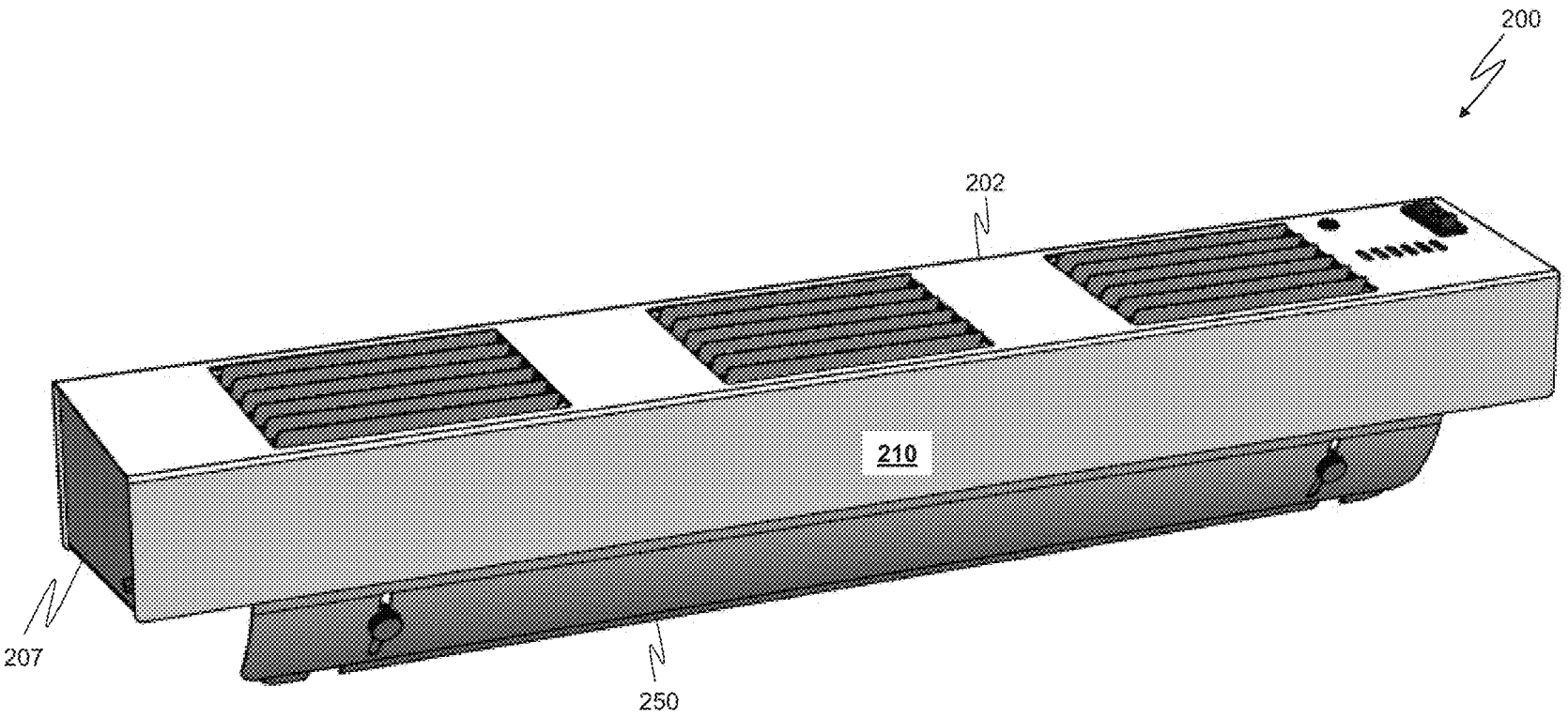
FIG. 4 is a front perspective view of a baseboard booster, in accordance with an embodiment of the invention.
Figure 5:
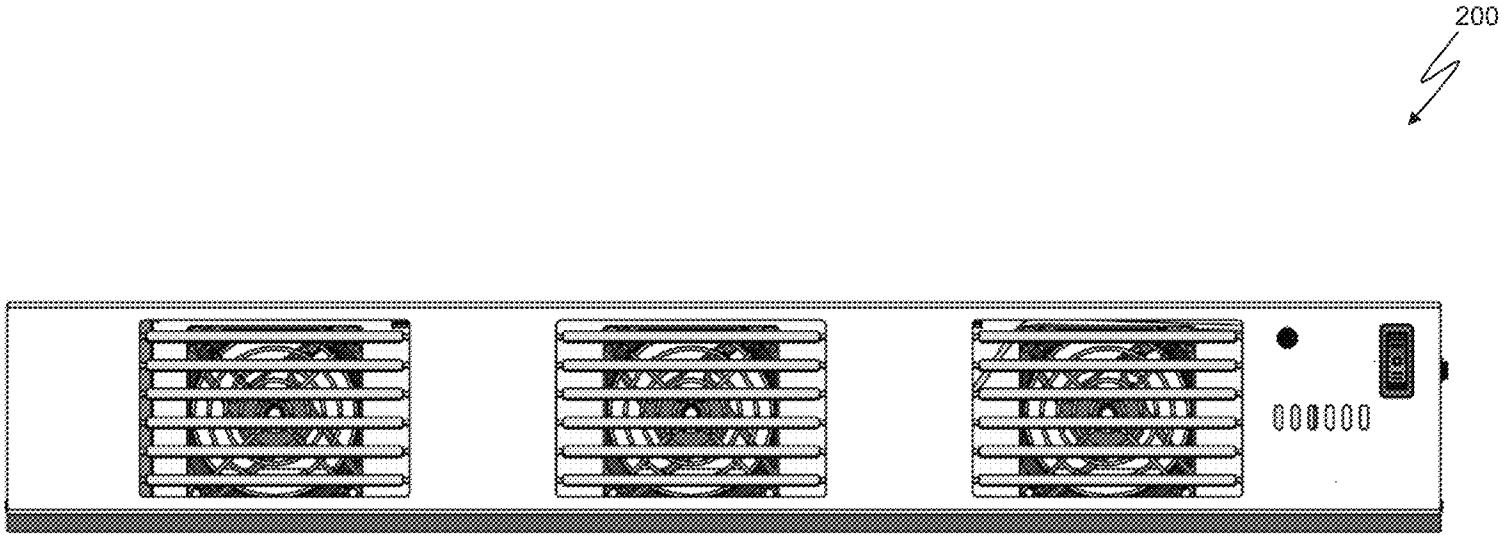
FIG. 5 is a top down view of a baseboard booster, in accordance with an embodiment of the invention.
Figure 6:
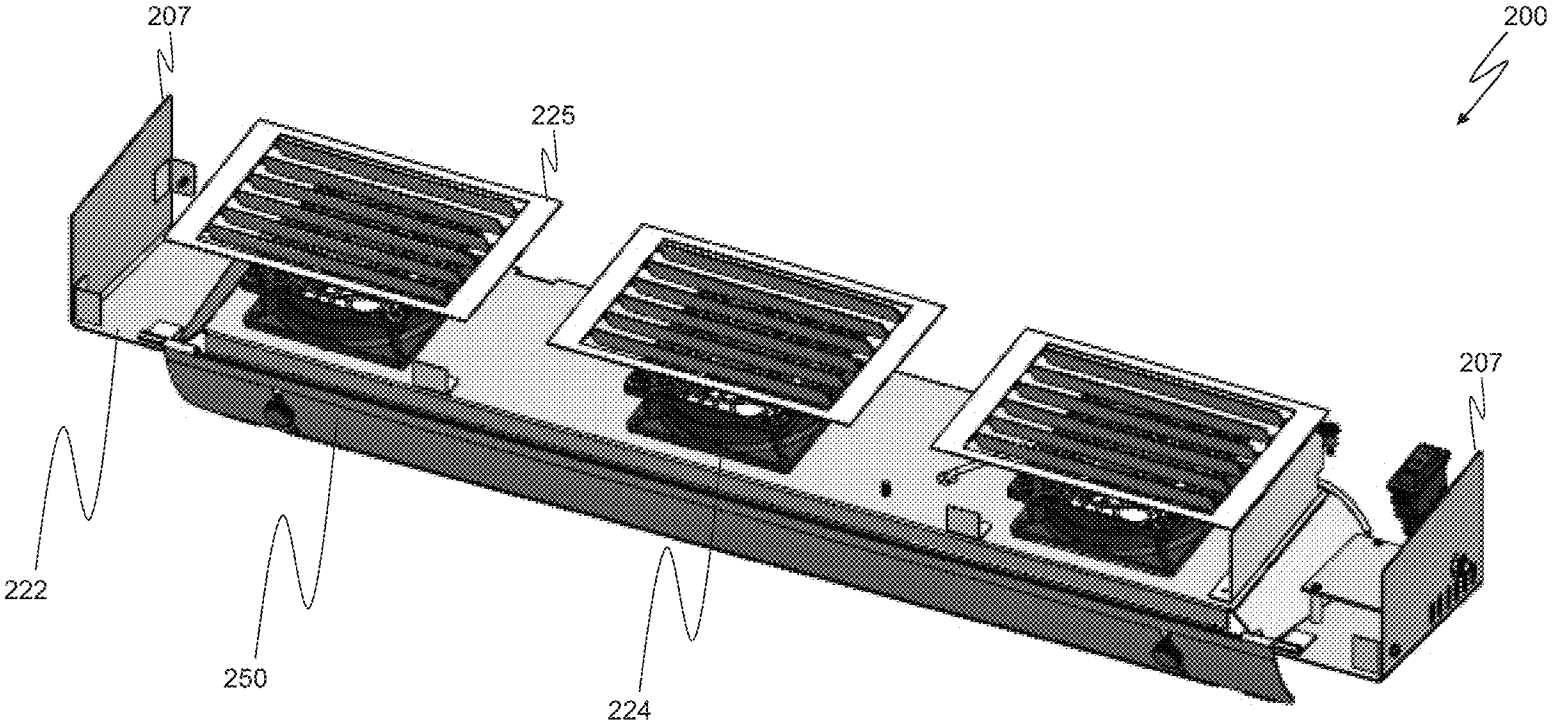
FIG. 6 is a front side perspective view of a baseboard booster without the booster structure, in accordance with an embodiment of the invention.
Figure 7:
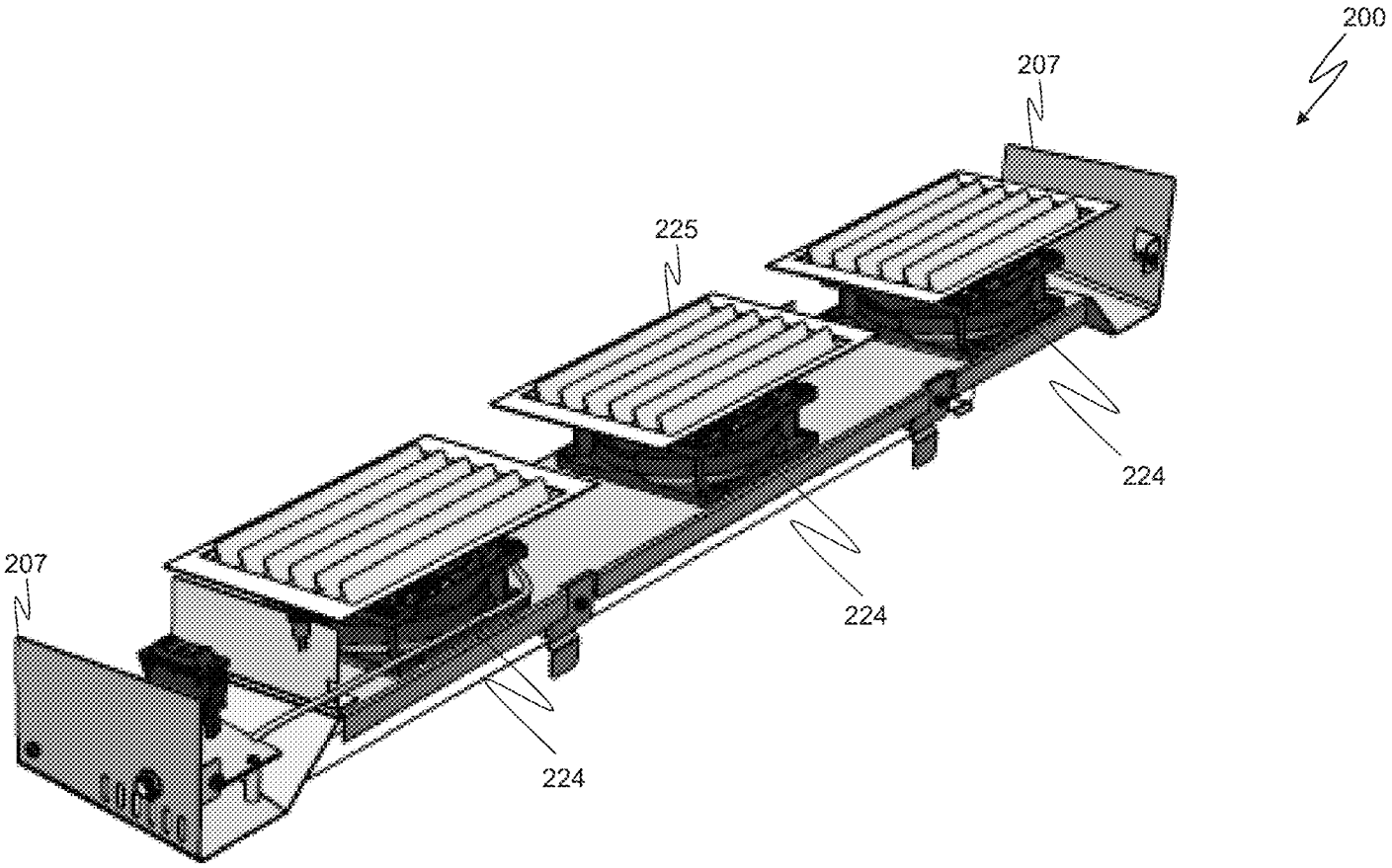
FIG. 7 is a rear side perspective view of a baseboard booster without the booster structure, in accordance with an embodiment of the invention.

As discussed briefly hereinabove, baseboard heating is generally expensive to operate and creates an uneven and inconsistent heat distribution within a room (i.e., hot areas, cold areas). In particular, the baseboard heating system typically includes a temperature sensor that senses the temperature in the room and that responds to that sensed temperature. However, because the heat from the baseboard heating element is allowed to heat the room via passive convection means or radiant means, the heat being emitted from the baseboard heating element tends to accumulate within certain areas of the room depending on the airflow in a particular room. Thus, depending on the location of the temperature sensor within a room, the room could develop hot spots and/or cold spots. This means that some locations in a room could feel several degrees cooler or warmer than what the system senses due to the location of the sensor. Additionally, this issue may be exacerbated because as hot air rises more of the heated air may become concentrated closer to the ceiling of the room thereby negatively affecting the room temperature at different heights and locations in the room.

Accordingly, the present invention provides a unique and novel baseboard booster article for efficiently distributing heated air being emitted from a baseboard heater. Referring to the FIGs, a baseboard heater 100 including a baseboard heating element (not shown) for heating air is shown having a self-contained baseboard booster 200 associated with the baseboard heater 100, according to an embodiment. It should be appreciated that the baseboard heater 100 may be any type of baseboard heater 100 (e.g., hydronic, convection) which emits air heated by electric and/or by fluid that is heated by any type of fuel (e.g., gas, oil, electric, etc.). The baseboard booster 200 is disposed and configured to increase and distribute the heated airflow that is emitted from the baseboard heater 100 by using one or more booster fans to pull air from the baseboard heater 100, through the baseboard booster 200 and out of the baseboard booster 200 into the airflow of a room. In addition, in an embodiment, the baseboard booster 200 may be configured to incorporate an ultraviolet air purifier and/or an auxiliary heating device to purify and/or increase the temperature of the heated airflow prior to being emitted from the baseboard booster 200. Furthermore, it is contemplated that the baseboard booster 200 may be incorporated into the design of the baseboard heater 100 and/or the baseboard booster 200 may be a retrofit device that can be added to existing baseboard heaters 100.

In accordance with an embodiment, the baseboard booster 200 facilitates airflow from the baseboard heater 100 by circulating the heat generated by the baseboard 100. The baseboard booster 200 is configured to easily attach to the cover of a baseboard heater 100 and to include one or more fans (and/or a single cross flow fan) to efficiently circulate the heated airflow into the room. This distributes the heated airflow more efficiently and quickly, thereby reducing the time it takes to get the temperature of a room up to a desired temperature. Moreover, the baseboard booster 200 may include a heat detection sensor or thermostat that automatically turns the device ON/OFF responsive to whether heat is detected as being emitted from the baseboard heater 100. Accordingly, the baseboard booster 200 may include a thermal/heat sensor which senses temperature of the airflow from the baseboard heater 100 and turns on or off based on a predetermined temperature threshold of the temperature of the airflow coming from the baseboard heater 100.

In accordance with an embodiment and as discussed briefly hereinabove, the baseboard booster 200 may also incorporate an air purifier. Thus, as the heated airflow flows through the baseboard booster 200, the heated airflow interacts with an air purifier (e.g., an ultraviolet light, such as UV-C (or other purifying light source) and/or any other type of air purifier). The baseboard booster 200 facilitates the heated airflow by gently increasing and circulating the heated airflow generated by the baseboard heater 100. In an embodiment, the baseboard booster 200 is configured to easily attach to the cover of the baseboard heater 100. The attachment of the baseboard booster 200 to the cover of the baseboard heater 100 may be performed by the user and does not require the hiring of a contractor. Moreover, in an embodiment, the baseboard booster 200 may have a simple, lightweight design that allows the baseboard booster 200 to be moved from a baseboard heater 100 in one room to a baseboard heater 100 in another room, thereby allowing a user increase heating airflow in a desired space (such as a "drafty" area) with the need to "turn up" the heat in a specific room. The baseboard booster 200 improves the thermal comfort level of any room and heats most average sized rooms up to three (3) times faster than rooms with just a baseboard heater 100.

Additionally, the baseboard booster 200 may be used in any number of different locations. For example, the baseboard booster 200 can be used in any location that uses baseboard style heating, such as private homes, apartments, commercial properties, government buildings, etc. It should be appreciated that the example baseboard booster 200 is an easily installed and cost-saving energy efficient system for any type of baseboard heater 100. The baseboard booster 200 allows a user to lower the thermostat in barely used rooms while maintaining a comfortable temperature in rooms that are occupied the most. For example, adjusting the thermostat by 4 degrees, such as from 72 degrees to 68 degrees, can save 10% in energy costs. As another example, in a 2500 square foot home, lowering the thermostat from 72 to 68 degrees can reduce the amount of fuel used for heating from 880 gallons of fuel to 792 gallons. In this scenario, the potential fuel savings may exceed $500 USD per year and with the recent increase in fuel costs, this can present an even greater savings over time. In addition, a baseboard heater 100 which utilizes a baseboard booster 200 can increase room temperature 2-3 times faster than a baseboard heater 100 without a baseboard booster 200.

Referring to the FIGs, a baseboard booster 200 is shown, in accordance with an embodiment, and includes a booster structure 202 having a structure first end 204, a structure second end 206, a structure top 208, a structure first side 210 and a structure second side 212. The structure top 208, structure first side 210 and structure second side 212 extends between the structure first end 204 and the structure second end 206 to define a booster structure cavity 214. Moreover, the booster structure 202 defines a bottom opening 216 which is communicated with the booster structure cavity 214 and which extends between the structure first end 204 and the structure second end 206. It should be appreciate that in one embodiment, the structure first end 204 and the structure second end 206 may include an end wall 207 to enclose sides of the booster structure cavity 214, while in another embodiment, the structure top 208, structure first side 210 and structure second side 212 may define a first end opening 218 and a second end opening 220, wherein the first end opening 218 is disposed proximate the structure first end 204, and wherein the second end opening 220 is disposed proximate the structure second end 206.

In an embodiment, the booster structure 202 further includes an internal support plate 222 securely disposed within the booster structure cavity 214 and configured to extend at least a partially between the structure first end 204 and the structure second end 206. The internal support plate 222 is configured to securely support one or more fans 224 within the booster structure cavity 214. It should be further appreciated that the structure top 208 defines a plurality of top openings 226 that are communicated with the booster structure cavity 214. The one or more fans 224 are securely associated with the internal support plate 222 and disposed such that, when the baseboard booster 200 is associated with a baseboard heater 100, operation of the one or more fans 224, causes a heated airflow created by the baseboard heater 100, to flow into the booster structure cavity 214 via the bottom opening 216, through the one or more fans 224 and out of the plurality of top openings 226. It should be appreciated that an air purifier may be associated with the inlet of the one or more fans 224 and/or the outlet of the one or more fans 224 to purify the airflow being output from the baseboard booster 200.

In an embodiment and referring again to the FIGs, the baseboard booster 200 is a ventilating device that is securely associated with a top portion 102 of a baseboard heater 100. The booster structure 202 is associated with the baseboard heater 100 such that the booster structure 202 covers a portion of the top portion 102 of the baseboard heater 100 and such that the top portion 102 of the baseboard heater 100 is communicated with the bottom opening 216 of the booster structure 202. As such, heated air generated from the baseboard heater 100 flows up and out of the top portion 102 of the baseboard heater 100 and into the bottom opening 216 of the booster structure 202. A temperature sensor 228, which may be disposed within (or external to) the booster structure cavity 214, may sense heat generated from the baseboard heater 100 and cause the baseboard booster 200 to turn on the one or more fans 224. It should be appreciated that one or more of the one or more fans 224 (and/or louvers 225) may be movable (e.g., rotatable) to direct the airflow flowing out of the baseboard booster 200 in multiple directions, including out of the top openings 226 and/or out of the first end opening 218 and/or the second end opening 220. It should be further appreciated that in other embodiments, louvers 225 may be rotatable and/or adjustable in a side-to-side, up-and-down fashion.

Referring again to the FIGs, one embodiment of the baseboard booster 200 is shown and includes three fan locations in the internal support plate 222. Also, an air purifier (e.g., an ultraviolet light source (not shown), such as a UV-C light) source may be positioned inside the booster structure cavity 214 and used to purify the air to remove germs and microbes. The UV-C light source may be positioned along the entire length of the booster structure cavity 214 and/or may be positioned at certain points within the booster structure cavity 214.

Moreover, an ON/OFF switch 230 may be positioned on a surface of the baseboard booster 200 for turning the baseboard booster 200 between the ON/OFF configuration. As discussed briefly hereinabove, the structure first side 210 and/or structure second side 212 be configured to extend over and around the top end of the baseboard heater 100 so that the top portion 102 of the baseboard heater 100 may be partially positioned within the booster structure cavity 214 and such that the structure first side 210 and structure second side 212 securely seats and/or clamps around the baseboard heater 100. In another embodiment, the structure first side 210 and/or the structure second side 212 may not extend down, rather a hinged air collector/scoop/flap structure 250 may be included and associated with one of the structure first side 210 and/or structure second side 212 to collect and direct heated air from the baseboard heater 100 into the baseboard booster 200. These allows the baseboard booster 200 to collect heated air from the baseboard heater 100 and direct the heated air into the booster structure cavity 214. Additionally, it is contemplated that the structure first side 210 and/or the structure second side 212 may be one contiguous wall or may be a wall that is made of multiple parts to permit part of the structure first side 210 and/or the structure second side 212 to bend. It should be appreciated that in one embodiment, the first end opening 218 and the second end opening 220 may permit the baseboard booster 200 to seat on varying lengths of baseboard heaters 100. While in another embodiment, the baseboard booster 200 could be sized to fit any sized baseboard heater 100. Accordingly, in an embodiment, the baseboard booster 200 may be configured to be extendable to accommodate longer baseboard heaters 100. As such, the baseboard booster 200 may be connected in a 'daisy chain' fashion to either side of one or more additional baseboard boosters 200 to extend the length of the baseboard booster 200.

It should be appreciated that the one or more fans 224 may include screens to prevent/limit debris and/or other objects (such as fingers) from entering the one or more fans 224 and being struck from the fan blades. The one or more fans 224 may have variable speeds that may be selected by the user using a dial or some other suitable adjustment device, or the one or more fans 224 may be a single speed. The one or more fans 224 may be turned on and off by the ON/OFF switch 230 or via a separate switch from the ON/OFF switch 230. Additionally, the UV light source may be turned on an off by a switch, which may be the same ON/Off switch 230 or a separate switch. It should be appreciated that the baseboard booster 200 may include a standard plug (or may be hardwired) to allow the baseboard booster 200 to be powered the building power and the baseboard booster 200 may include a backup battery to power the baseboard booster 200 when building power is lost. Moreover, the baseboard booster 200 may be securely associated with the baseboard heater 100 using any method and/or device suitable to the desired end purpose, such as clip, magnets, adhesive, hooks, screws, etc.

According to one embodiment, a baseboard booster 200 may include a housing, at least one fan, and a UV light source positioned inside the housing. The baseboard booster 200 may be configured to seat and/or clamp on top of a baseboard heater 100 and may have a bottom opening 216 and one or more top openings 226 for expelling heated air therethrough. The one or more fans 224 is positioned inside the booster structure cavity 214 is oriented to draw heated air from the baseboard heater 100 and to expel the heated air through the one or more top openings 226. The UV light source may be positioned in the booster structure cavity 214 for purifying the heated airflow being expelled. The one or more top openings 226 may be any shape and/or may be directional slots and/or may include directional deflectors to direct the airflow in a desired direction. The UV light source may be a UV-C light source.

It is contemplated that in an embodiment, the baseboard booster 200 may include a processing device for controlling the operation of the baseboard booster 200 (e.g., fans 224, purifier, etc.) and may be configured to wirelessly communicate with a remote device (iPad, tablet, laptop computer, desktop computer, pda, iPhone, etc.) via any wireless or hardwired communication method suitable to the desired end purpose (e.g., NFC WiFi, Bluetooth, internet, cellular, etc.), wherein the remote device may receive temperature and/or operational information and control the operation of the baseboard booster 200. Additionally, the baseboard booster 200 may include an apparatus for automatically turning the baseboard booster 200 (or individual components within the baseboard booster 200, such as a UVC light, a fan, etc.) on or off responsive to temperature, operating time, etc. In an embodiment, one type of apparatus for turning the baseboard booster 200 on or off may be a thermal sensor that detects the heat level within the booster and turns the baseboard booster on/off based on a predetermined upper and/or lower temperature threshold.

Figure 8B:
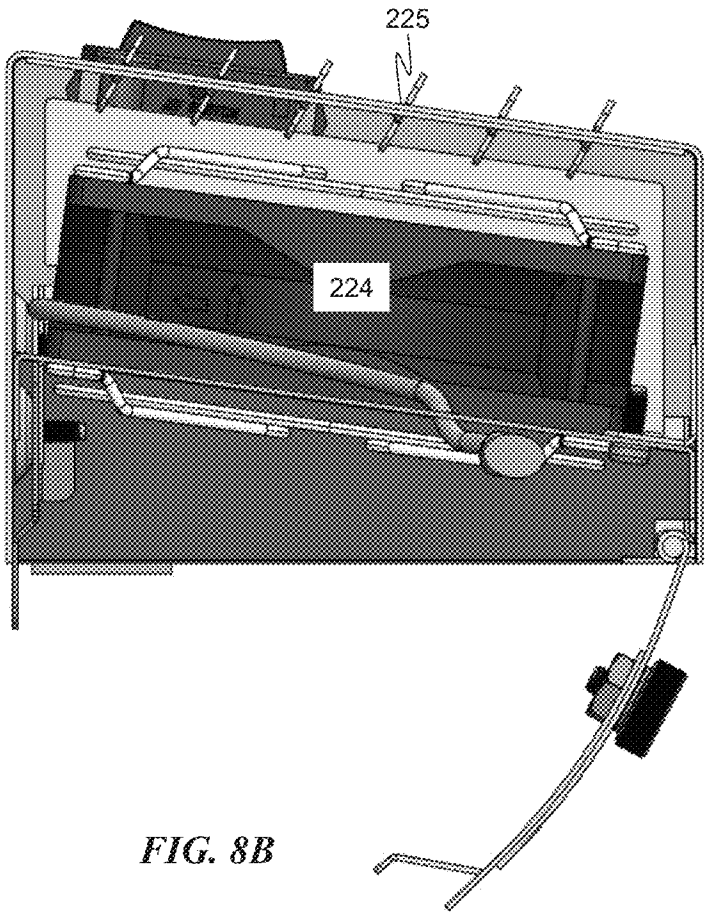
FIG. 8B is a side view of a booster side without the booster structure, in accordance with an embodiment of the invention.
Figure 8A:
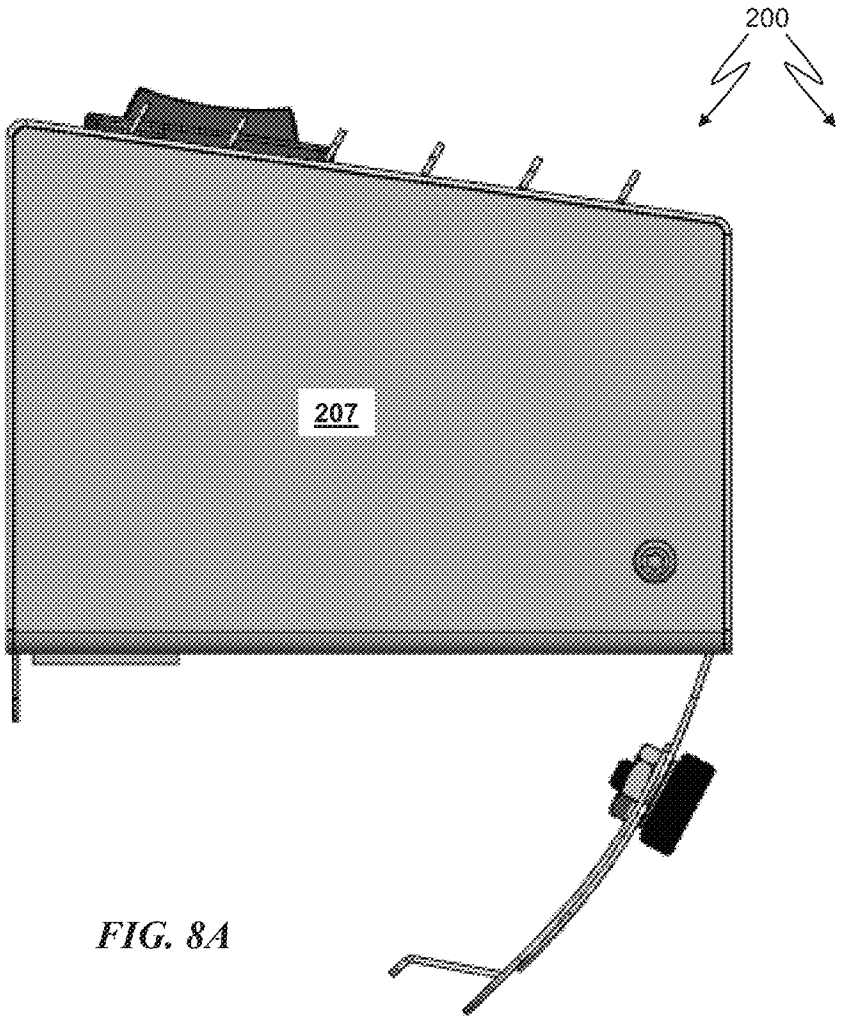
FIG. 8A is a side view of a baseboard booster, in accordance with an embodiment of the invention.
Figure 8C:
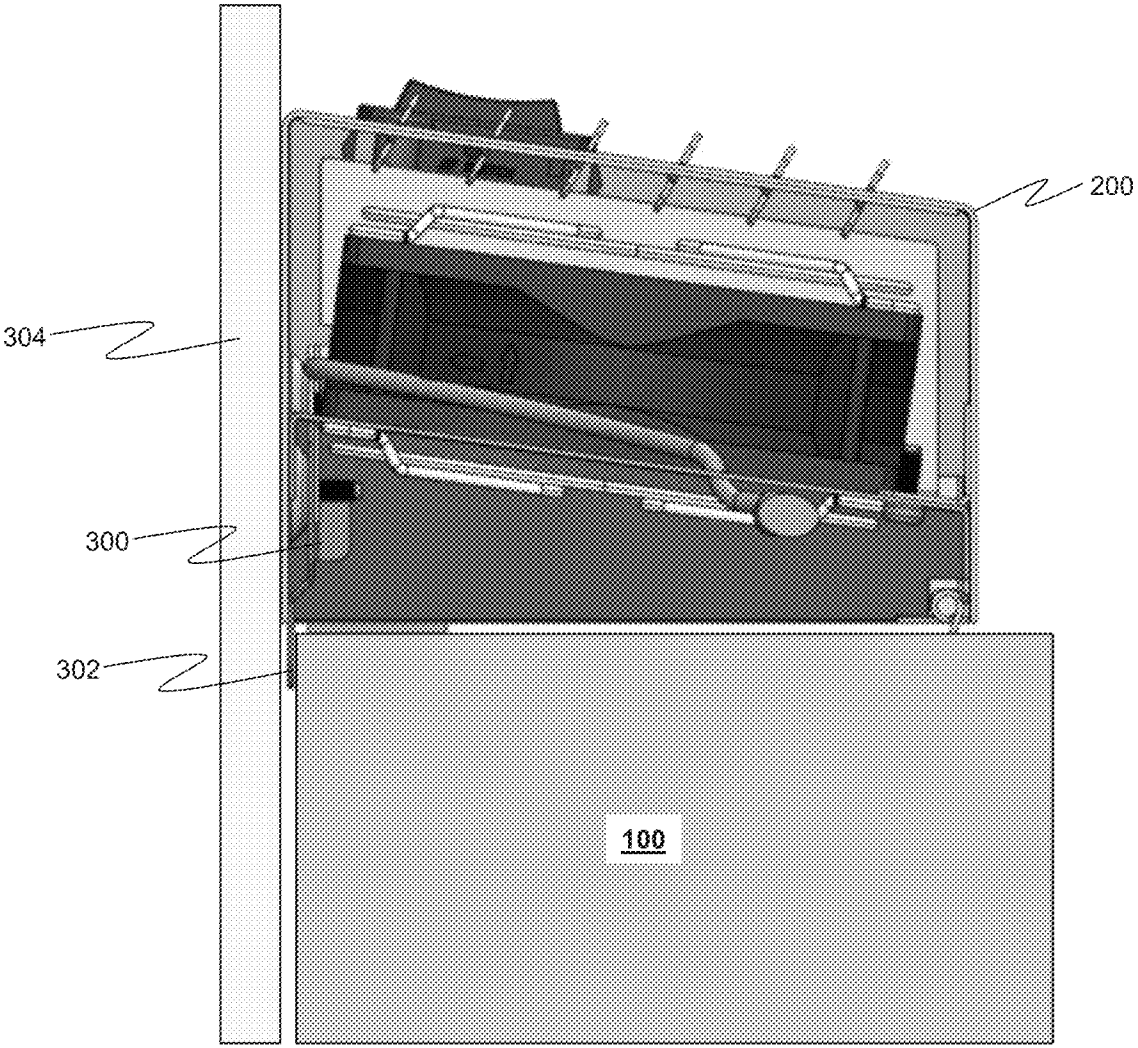
FIG. 8C is a side view of a baseboard booster associated with a baseboard heater, in accordance with an embodiment of the invention.
Figure 8D:
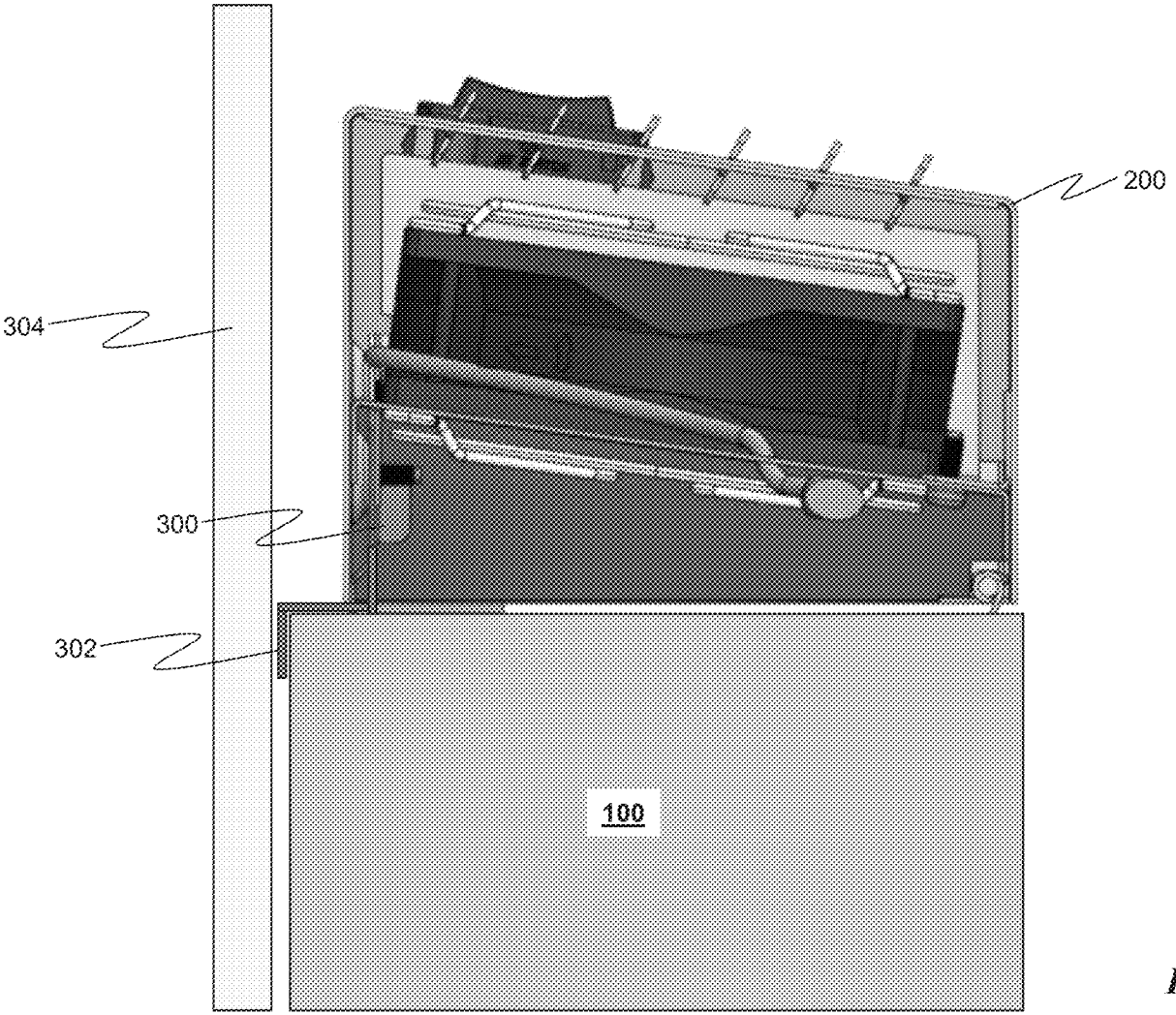
FIG. 8D is a side view of a baseboard booster associated with a baseboard heater, in accordance with an embodiment of the invention.
Figure 9C:
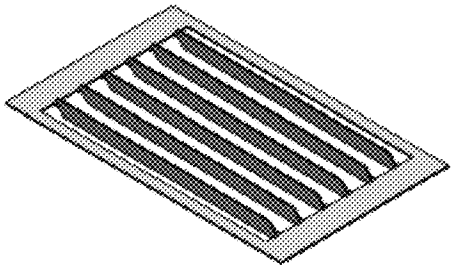
FIG. 9C is a side perspective view of the louvers of FIG. 9B, in accordance with an embodiment of the invention.
Figure 9B:
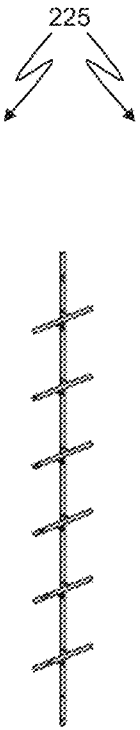
FIG. 9B is a side view of the louvers of FIG. 9B, in accordance with an embodiment of the invention.
Figure 9A:
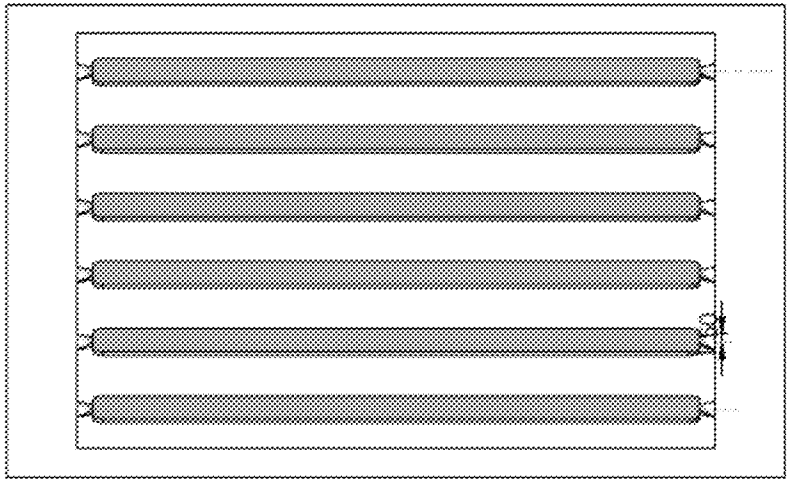
FIG. 9A is a top down view of louvers for use with a baseboard booster, in accordance with an embodiment of the invention.
Figures 10A, 10B:
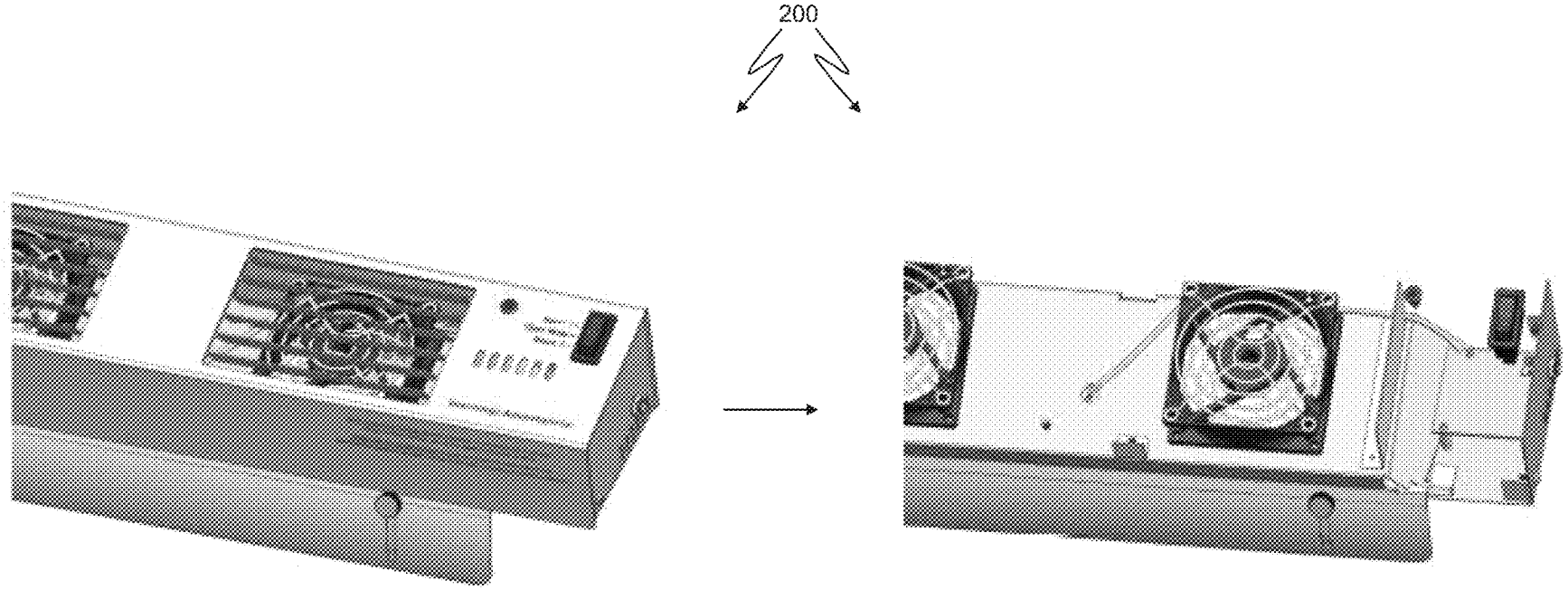
FIG. 10A is a perspective view of one end of a baseboard booster, in accordance with an embodiment of the invention.
FIG. 10B is a perspective view of the baseboard booster of FIG. 10A without the booster structure, in accordance with an embodiment of the invention.

Referring to FIGS. 8A, 8B and 8C, the baseboard booster 200 may include a mounting article 300 which securely mounts to the structure second side 212, wherein the mounting article 300 includes an interface lip 302 that extends downward from the booster structure 202. The mounting article 300 may be retractable and/or removable as desired. When the baseboard booster 200 is associated with a baseboard heater 100, the interface lip 302 is disposed between a wall 304 and the back of the baseboard heater 100 to remain vertically oriented and to securely and stably associate the baseboard booster 200 with the baseboard heater 100. It should be appreciated that for situations where the baseboard booster 200 may be associated with a baseboard heater 100 that is not plum with the wall 304, an alternate shaped mounting article 300 may be used where the interface lip 302 is extended backward from the baseboard booster 200 (See FIG. 8D). Additionally, for situations where an extended interface lip 302 is not required, a thick sleeve may be provided to fit over the interface lip 302 to make the interface lip 302 fit more snugly and securely between the wall 304 and the back of the baseboard heater 100.

It should be appreciated that in still other embodiments, the baseboard booster 200 may also include one or more of the following: an air purification filter associated with the one or more fans 224 for filtering the heated airflow, a humidifier reservoir (such as a container, a sponge, a water drip, etc.) to maintain the heated airflow at a desired humidity level, a high temperature warning alarm to ensure that the baseboard booster 200 does not overheat and become a fire hazard, a universal mounting configuration for both hot water and electric baseboards, retractable mounting clips that fit between the baseboard heater 100 and the wall, adjustable wall clip extensions to allow the baseboard booster 200 to be properly positioned on baseboard heaters 100 having a larger front-to-back baseboard styles, an adhesive surface to allow the baseboard booster 200 to be secured to the top of a baseboard heater 100, a magnetic mount to allow the baseboard booster 200 to magnetically mount to metal baseboard heaters 100, an adjustable deflector article that can direct heated airflow from baseboard fins of the baseboard heater 100 into the baseboard booster 200, fixed multiple hooks attached to the adjustable deflector to position and hold baseboard booster 200 to the baseboard heater 100, adjustable extension legs to support the baseboard booster 200 on a baseboard heater 100, angled (and/or rotatably adjustable and/or directionally adjustable) louvers to deflect the heated airflow from the one or more fans 224 into the room, a 3-position switch to allow for multiple fan speeds (very low fan speed, low boost fan speed and/or high boost fan speed), an LED to indicate power on/off, an LED (or LCD) display for temperature/operation status display, optimal temperature sensor location (i.e., front forward underside of the baseboard booster 200 between two of the one or more fans 224), and/or a baseboard booster 200 control unit (i.e., a microcontroller-based circuit including a microcontroller, a temperature sensor, an LED/LCD readout, a fan speed monitor/selection switch, a DC and/or AC power source, a voltage regulator, etc.) and/or configurable Fan operational control, fan hysteresis-prevention times.

Moreover, in one or more embodiments, the baseboard booster 200 may be configurable such that threshold temperatures may be preset for efficiency and effectivity. Also, temperatures thresholds and timing may be preset to prevent frequent on/off/on fan operation from room temperature fluctuations during operation. The baseboard booster 200 may include an off temperature set to allow the baseboard booster 200 to run after the baseboard heater 100 has turned off to efficiently harvest any residual heat. In an embodiment, the baseboard booster 200 may be configured such that when the one or more fans 224 are not running and the user changes the fan speed, or when the baseboard booster 200 is initially plugged in, the one or more fans 224 may run at the new speed for a short period of time (e.g., 3 to 10 seconds) as a test sample. In this way a user may be assured that they have moved the fan speed switch to the desired position without having to read and interpret markings on the switch and/or housing. This may also help assure that baseboard booster 200 is properly plugged in and properly working.

In another embodiment, a heat burst button may be provided and may be configured to allow temporary changes in fan speed for maximum airflow (by time or cycles), before automatically returning to the selected speed. For example, when a user comes in from cold outdoors, and desires a quick warm up, but doesn't want the fan speed to always be set to high speed. Additionally, a silence button may be provided to temporarily change the fan speed for minimum airflow and noise (by time or cycles), before automatically returning to the selected speed. For example, if a user is on the telephone and desires minimal sounds from the baseboard booster 200.

In still yet another embodiment, magnets and/or magnetic material may be provided to an underside portion of the booster structure 202 of the baseboard booster 200 to improve physical stability of the baseboard booster 200. Also, cushioning and/or dampening material may be provided on the bottom of the baseboard booster 200 and/or the fan mounting to minimize vibration and sound transference to reduce noise amplification caused by the "drum head" effect caused by induced vibrations onto the baseboard booster 200 and the baseboard heater 100. In another embodiment, the baseboard booster 200 may include a safety switch to prevent the one or more fans 224 from turning on if an integrated mechanical and/or magnetic switch does not indicate that the baseboard booster 200 is located on a baseboard heater 100. Additionally, a safety sensor may be provided to prevent the one or more fans 224 from turning on if the baseboard booster 200 is tilted indicating that the baseboard booster 200 is unstable. In another embodiment, a warning indicator light (various colors for different warnings) may be provided to warn when the baseboard booster 200 is on, but one (or more) of the one or more fans 224 are not operating (for example, red light-off, green light-on, amber light-fan not working, etc.). In still yet another embodiment, the baseboard booster 200 may include a high heat override, where if an internal temperature exceeds a predetermined threshold temperature (e.g., 70° F., 75° C., etc.), a resettable thermal fuse may be triggered, thereby causing the one or more fans 224 to run at top speed. A thermal fuse may be directly connected to the one or more fans 224, bypassing all other sensors and electronics. The one or more fans 224 may return to normal operation when the internal temperature falls below the predetermined threshold. Additionally, in an embodiment, the one or more fans 224 may be controllable as a group and/or each of the one or more fans 224 may be independent controllable, whereby a processor may control the operation and speed of each fan individually.

In accordance with an exemplary embodiment, the baseboard booster of the invention may be operated and implemented through a controller operating in response to a computer program and/or microcontroller program/code. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt(s), communication interface(s), and input/output signal interface(s), as well as combination comprising at least one of the foregoing. Moreover, the method of operating the invention may be embodied in the form of a computer or controller implemented processes and apparatuses for practicing those processes. As such, the embodiments described hereinabove and in the several figures may also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention.

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A baseboard booster article for use with a baseboard heater having a baseboard heater front opening disposed in a top side portion of the baseboard heater, comprising:

a booster housing, wherein the booster housing defines a housing cavity and a housing bottom opening and includes a housing top having at least one horizontally arranged, vertically directed top opening;

a booster support structure, wherein the booster support structure is disposed within the housing cavity;

an air collector associated with the baseboard heater front opening to direct a heated airflow coming out of the baseboard heater front opening toward the booster housing and to increase the heated airflow flowing into the housing bottom opening, wherein the air collector completely covers the baseboard heater front opening along a length of the booster housing; and at least one horizontally disposed fan associated with the booster support structure to be located within the housing cavity, wherein the at least one fan includes a vertically directed air intake opening and a vertically directed air outflow opening and is configured to cause the heated airflow to flow into the housing bottom opening, into the vertically directed air intake opening, out of the vertically directed air outflow opening and out of the at least one horizontally arranged, vertically directed top opening.

2. The baseboard booster article of claim 1, wherein the at least one top opening includes a plurality of top openings.

3. The baseboard booster article of claim 2, wherein the baseboard booster article includes a plurality of louvers associated with the plurality of top openings to direct an airflow flowing out of the plurality of top openings in a predetermined direction.

4. The baseboard booster article of claim 1, further comprising, a mounting article having an interface lip, wherein when the baseboard booster article is associated with a baseboard heater, the interface lip is configured to be disposed between the baseboard heater and a wall, and wherein the air collector is associated with the booster housing to extend below the booster housing such that when the baseboard booster article is associated with the baseboard heater, the air collector directs and increases the heated airflow from the baseboard heater into the housing cavity.

5. The baseboard booster article of claim 4, wherein the at least one fan includes a plurality of fans and wherein each of the plurality of fans are configured to be at least one of directionally movable individually and directionally movable as a group, while the baseboard booster article is associated with the baseboard heater.

6. The baseboard booster article of claim 1, further including a temperature sensor disposed to be associated with the booster housing to sense a heated airflow being introduced into the housing cavity via the housing bottom opening.

7. The baseboard booster article of claim 1, wherein the booster housing further includes a structure first end, a structure second end, a structure first side and a structure second side, wherein the structure first end, structure second end, structure first side and structure second side define the housing cavity.

8. The baseboard booster article of claim 1, wherein the booster housing further includes a structure first side and a structure second side, and wherein the booster housing is configured to securely associate with a top portion of a baseboard heater having a baseboard front and a baseboard rear, such that at least one of the structure first side and the structure second side partially overlaps at least one of the baseboard front and the baseboard rear.

9. The baseboard booster article of claim 1, further comprising a processing device configured to be in wireless connection with a remote device, to receive operational commands from the remote device, and to transmit temperature and fan operational status information to the remote device.

10. The baseboard booster article of claim 9, further comprising a temperature sensor, wherein the processing device is communicated with the temperature sensor and the at least one fan, and wherein the processing device is configured to control the operation of the at least one fan responsive to at least one of the temperature sensor and the remote device.

11. A baseboard booster article, comprising:

a booster housing, wherein the booster housing includes a housing top, a housing first side and a housing second side, wherein the housing top, housing first side and housing second side define a housing cavity, a vertically directed housing top opening and a housing bottom opening, a booster support structure, wherein the booster support structure is disposed within the housing cavity;

an air collector associated with the baseboard heater to direct an airflow coming out of the baseboard heater front opening into the booster housing, wherein the air collector completely covers the baseboard heater front opening along a length of the booster housing; and a plurality of horizontally disposed fans associated with the booster support structure to be located within the housing cavity, wherein each of the plurality of fans includes a vertically directed air intake opening and a vertically directed air outflow opening and is independently configurable to cause an airflow to flow into the housing bottom opening, into the vertically directed air intake opening, out of the vertically directed air outflow opening and out of the vertically directed housing top opening.

12. The baseboard booster article of claim 11, wherein the housing top opening includes a plurality of top openings, and wherein the housing cavity is in flow communication with the housing bottom opening and the plurality of top openings.

13. The baseboard booster article of claim 12, wherein the baseboard booster article includes a plurality of louvers associated with the plurality of top openings to direct an airflow flowing out of the plurality of top openings in a predetermined direction.

14. The baseboard booster article of claim 11, wherein the at least one fan includes a plurality of fans and wherein each of the plurality of fans are configured to be at least one of operable individually and operable as a group.

15. The baseboard booster article of claim 14, wherein the plurality of fans are configured to be at least one of directionally movable individually and directionally movable as a group.

16. The baseboard booster article of claim 11, further including a temperature sensor disposed within the housing cavity to sense a heated airflow being introduced into the housing cavity via the housing bottom opening.

17. The baseboard booster article of claim 11, wherein the booster housing is configured to securely associate with the top portion of a baseboard heater having a baseboard front and a baseboard rear, such that at least one of the structure first side and the structure second side partially overlaps at least one of the baseboard front and the baseboard rear.

18. The baseboard booster article of claim 11, further comprising a processing device configured to be in wireless connection with a remote device, to receive operational commands from the remote device, and to transmit temperature and fan operational status information to the remote device.

19. The baseboard booster article of claim 18, further comprising a temperature sensor, wherein the processing device is communicated with the temperature sensor and the plurality of fans, and wherein the processing device is configured to control the operation of the plurality of fans responsive to at least one of the temperature sensor and the remote device.

20. A baseboard booster article for use with a baseboard heater having a baseboard heater front opening disposed in a top side portion of the baseboard heater, comprising:

a booster housing, wherein the booster housing defines a housing cavity and a housing bottom opening and includes a housing top having at least one top opening;

a booster support structure, wherein the booster support structure is disposed within the housing cavity;

an air collector associated with the baseboard heater front opening to direct a heated airflow coming out of the baseboard heater front opening into the booster housing, wherein the air collector completely covers the baseboard heater front opening along a length of the booster housing; and at least one horizontally disposed fan which increases and vertically directs the heated airflow out of the at least one top opening and wherein the at least one horizontally disposed fan is associated with the booster support structure to be located within the housing cavity, wherein the at least one fan is configured to cause the heated airflow to flow into the housing bottom opening, through the housing cavity and out of the at least one top opening, wherein the booster housing is configurable such that a second booster housing may be disposed against an end of the booster housing to extend an operational length of the baseboard booster article.

* * * * *